United States Patent [19]

Leale et al.

[11] Patent Number: 4,572,990

[45] Date of Patent: Feb. 25, 1986

[54] ELECTRONIC TRANSFORMER SYSTEM FOR NEON LAMPS

[75] Inventors: Luis Leale, San Diego; Edward A. Saunders, Lakeside; Enrique Keil, San Diego, all of Calif.

[73] Assignee: International Energy Conservation Systems, Rancho Santa Fe, Calif.

[21] Appl. No.: 554,185

[22] Filed: Nov. 23, 1983

[51] Int. Cl.[4] ..... H05B 37/02

[52] U.S. Cl. ..... 315/220; 315/205; 315/209 R; 315/224; 315/DIG. 7

[58] Field of Search ..... 315/205, 224, 209 R, 315/220, DIG. 7

[56] References Cited

U.S. PATENT DOCUMENTS

| | | | |
|---|---|---|---|
| 4,045,711 | 8/1977 | Pitel | 315/205 |
| 4,188,661 | 2/1980 | Bower | 315/224 |
| 4,353,009 | 10/1982 | Knoll | 315/224 |
| 4,370,600 | 1/1983 | Zansky | 315/209 R |

*Primary Examiner*—Harold Dixon
*Attorney, Agent, or Firm*—Charles H. Thomas

[57] ABSTRACT

An electronic transformer system for illuminating neon lamps includes a counterphase oscillator coupled to a leakage reactance power transference transformer. The power transference transformer has a secondary wound on a multiple section bobbin in which adjacent sections are separated from each other by a dielectric material. The leakage reactance power transference transformer has a feedback winding which is coupled in series to the primary winding of a pulse generator base driving transformer. The pulse generator base driving transformer in turn provides periodic pulses to the counterphase oscillator to reverse current flow in the primary of the leakage reactance power transference transformer. The electronic transformer system may be powered by commercial alternating current through a full wave rectifier, or by a direct current power supply.

10 Claims, 11 Drawing Figures

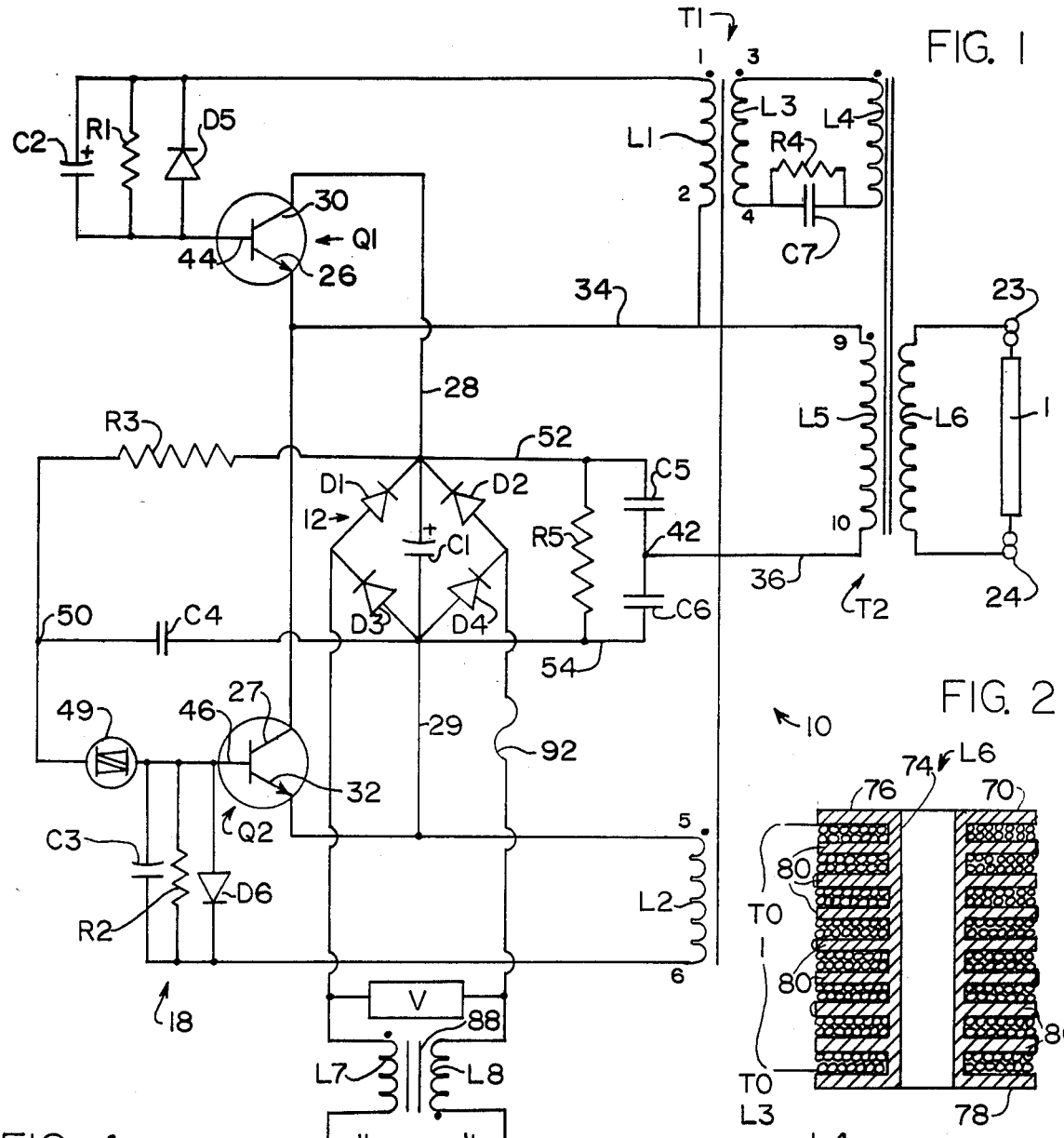
FIG. 1
FIG. 2
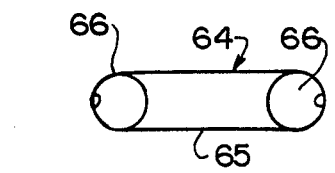
FIG. 4
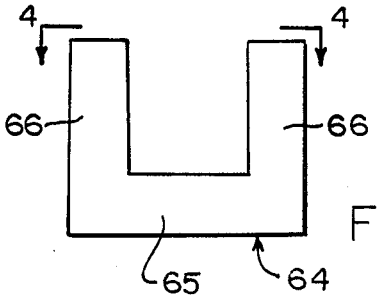
FIG. 3
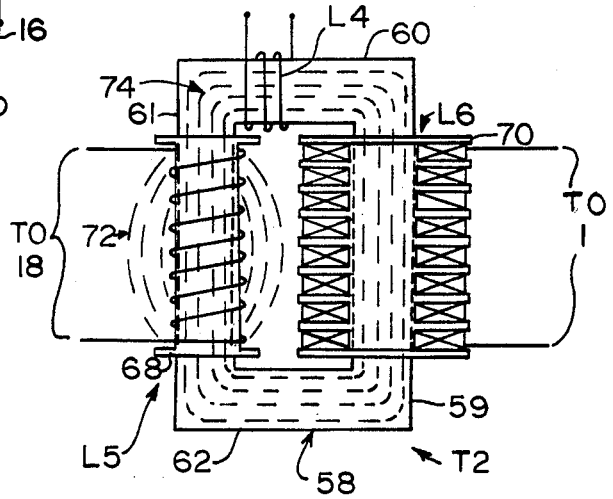
FIG. 5

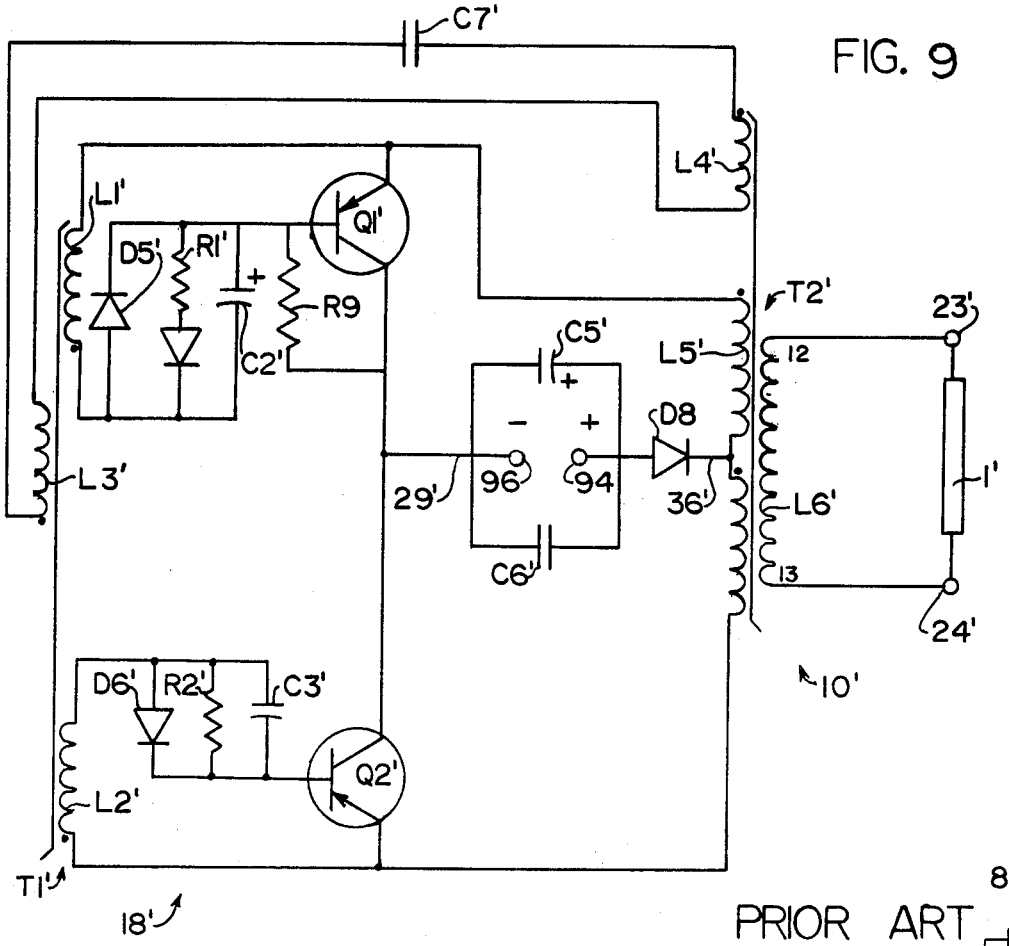
FIG. 9
PRIOR ART
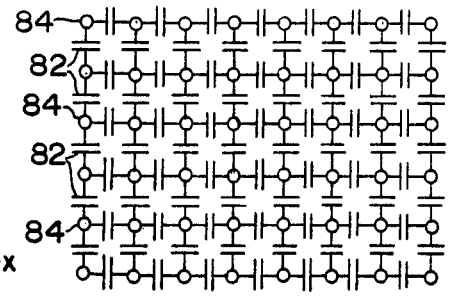
FIG. 6a
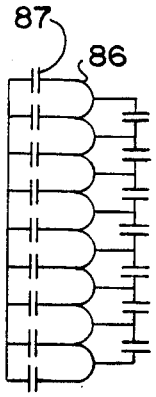
FIG. 6b
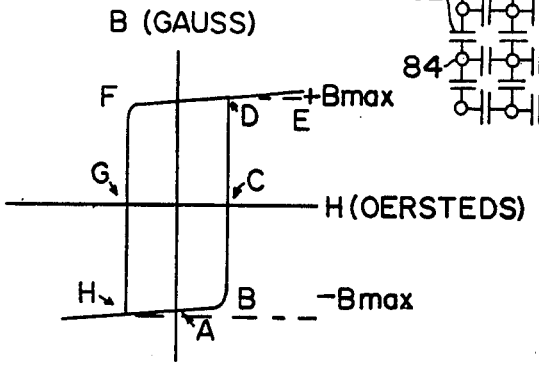
FIG. 8
FIG. 7a
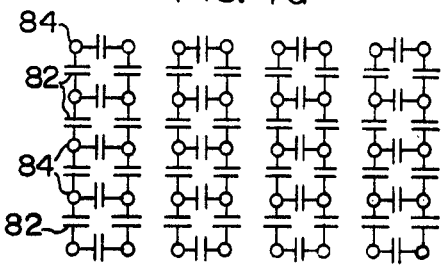
FIG 7b
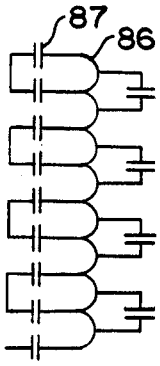

ELECTRONIC TRANSFORMER SYSTEM FOR NEON LAMPS

BACKGROUND OF THE INVENTION

1. Field of the Invention

The present invention relates to transformer systems for illuminating neon lamps.

2. Description of the Prior Art

Neon lamps are widely used in many different commercial and industrial applications. A neon lamp is formed of an evacuated glass bulb or envelope into which metal electrodes are sealed. The envelope contains a quantity of neon gas. No current is conducted between the electrodes until the ionization potential of the neon gas is reached. Thereupon, the neon gas is ionized and electricity is conducted through the ionized gas, which thereupon emits colored light. The neon gas is illuminated by an electronic discharge through the gas. Neon lamps find wide usage for advertising and display purposes because of the colorful illumination provided by the ionized neon gas.

Because illumination in a neon lamp occurs only during an electric discharge through the ionized gas, an ionizing potential must be applied to the neon lamp electrodes.

Until the present, only one type of transformer has been commercially available for use in powering neon lamps. The conventional type of transformer operates exclusively on the principle of transference and control of power by means of a bulky step-up transformer that is fed directly by the low frequency lines carrying commercial, alternating current as provided by public utility companies. Commercially available power is normally provided at a frequency of 60 hertz and at a voltage of 110, 115 or 120 volts.

Conventional transformers which are used to operate neon lamps, like any electro-magnetic device, are inherently noisy when operated from an alternating current of 60 hertz. The amount of noise varies to a degree dependent upon the size of the transformer. The reason for the noise is that lamp voltage waveforms contain harmonic components ranging from 120 hertz up to 3,600 hertz and even higher. Therefore, the noise generated by conventional transformer systems for driving neon lamps varies from a low pitched hum to a high pitched "rustle". In conventional transformers noise is generated by vibration of the transformer core and by stray magnetic fields which cause vibration of the transformer case or even of the luminaire in which the transformer is mounted.

One further disadvantage of conventional neon lamp transformers is the large volume and weight characteristic of such devices. Because a neon lamp requires a high starting voltage and a high operating voltage, the ballast impedance required to stabilize the negative impedance of this type of lamp is most readily accomplished with a leakage reactance transformer. Such transformers are quite large and bulky, and frequently must be located some distance from the lamp envelope.

SUMMARY OF THE INVENTION

The present invention is an electronic transformer system for illuminating neon lamps and which alleviates many of the problems associated with the conventional transformers which have heretofore been used to power neon lamps. Specifically, unlike prior art transformer systems, the leakage reactance transformer employed in the ballast or transformer system of the present invention is not powered directly from commercially available 60 hertz alternating electrical current. Rather, an electronic inverter is interposed between the public utility lines and the leakage reactance transformer input.

The electronic inverter employed in the transformer system of the present invention drives the leakage reactance power transference transformer primary winding at a much greater frequency than in conventional neon lamp transformers. The output frequency of the electronic inverter, and hence the frequency of the input to the power transference transformer, is typically about 25 kilohertz. The harmonic components of the lamp voltage are therefore 50 kilohertz or even greater. As a consequence, both the fundamental waveform to the primary of the ballast transformer, and the harmonics of that waveforms lie beyond the audible range. As a result, the transformer system of the present invention operates with practically no sound.

Another feature of the present invention is the provision of an electronic transformer which is only a fraction of the weight of a conventional transformer for neon lamps. Conventional transformers of this type require heavy ferromagnetic cores. The large weight of the conventional transformer requires neon lamp displays to be mounted in large, heavy frames. The transformer system of the present invention, however, reduces the structural requirements for neon lamp fixture supports, thereby providing a considerable savings in the cost of construction of the frames and fixtures.

A further advantage of the electronic transformer system of the present invention is that far greater efficiency in operation is achieved as contrasted with the operation of a conventional transformer. The electronic transformer system of the invention provides the same light output as a conventional transformer while consuming only about 60% of the power required by such a conventional transformer.

The National Electrical Code requires that all transformers must be installed as close to the lamps which they operate as practical so as to insure that the conductors from the transformer secondary are as short as possible. When it is necessary for the secondary conductors to pass within a wall, special insulating sleeves of glass material must be provided about the conductor where it passes through any concealed space. The necessity for the provision of such special insulating sleeves frequently occurs in mounting conventional transformers because of the large size and weight of such conventional transformers.

The transformer system of the present invention is lighter in weight and smaller in size than conventional transformers. Indeed, the transformer system of the invention occupies only about one-third of the volume of a conventional electrical transformer. As a result, it is very frequently possible to position the much smaller transformer system of the present invention inside of a lamp casing, where it would be impossible to do so with conventional transformers. As a result, the length of the secondary conductors of the transformer system are greatly reduced, which results in a very significant saving in installation costs. Furthermore, the very short length of the secondary output leads enhances the safety of the transformer system of the invention.

Another significant advantage of the present invention is that in the electronic transformer system the short circuited current is zero. In conventional transformers for neon lamps the short circuited current in the transformer secondary output ranges from between about 10 and 60 milliamps, depending upon the type and model of the transformer. As a result, in an accidental short circuit of lengthy duration the transformer will heat up and will be destroyed by the heat. In the transformer system of the present invention, no heating of the power transference transformer occurs because the short circuit current in the secondary is zero.

The invention is not restricted to use with conventional neon lamps. Quite to the contrary it is useful in any cold cathode application, such as ultraviolet lighting, or any other cold cathode lighting system.

The invention may be described with greater clarity and particularity by reference to the accompanying drawings.

DESCRIPTION OF THE DRAWINGS

FIG. 1 is a schematic diagram of the electronic transformer system of the invention utilized with an alternating current input.

FIG. 2 is a cross-sectional elevational view of the wound bobbin of the secondary of the power transference transformer of FIG. 1.

FIG. 3 is an elevational view showing one of the two mating components of the power tranference transformer core.

FIG. 4 is a view taken along the lines 4—4 of FIG. 3.

FIG. 5 is a diagrammatic view illustrating the power transference transformer employed in the electronic transformer systems of FIG. 1.

FIG. 6*a* is an exemplary equivalent lay-out or pictorial image illustrating stray capacitance between layers, turns and windings in a single section bobbin of a prior art power transference transformer.

FIG. 6*b* is an exemplary equivalent circuit showing the stray capacitance between turns, layers and windings in a multi-section bobbin in a power transference transformer according to the invention.

FIG. 7*a* is an exemplary equivalent lay-out or pictorial image showing the stray capacitance between turns, layers and windings in a multi-section bobbin in a power transference transformer according to the invention.

FIG. 7*b* is an exemplary equivalent circuit showing the stray capacitance and inductance in a multi-section bobbin in a power transference transformer according to the invention.

FIG. 8 illustrates the hysteresis loop of the pulse generator base driving transformer in the embodiment of the invention depicted in FIG. 1.

FIG. 9 is a schematic diagram of an electronic transformer system according to the invention operated from a direct current power source.

DESCRIPTION OF THE EMBODIMENTS

FIG. 1 illustrates a solid state electronic transformer system 10 designed to operate a conventional neon lamp 1. The electronic transformer system 10 employs a full wave rectifying circuit 12 for receiving alternating current power as an input on AC lines 14 and 16. The rectifying circuit 12 provides direct current power as an output to a counterphase oscillator circuit indicated at 18. A leakage reactance power transference transformer T2 is comprised of a primary winding L5 which is coupled to the counterphase oscillator circuit 18, a secondary winding L6 which is coupled to neon lamp terminals 23 and 24, and a feedback winding L4. A pulse generator base driving transformer T1 has a primary winding L3 coupled in series to the feedback winding L4 of the leakage reactance power transference transformer T2. The secondary windings L1 and L2 of the pulse generator base driving transformer T1 cyclincally drive the counterphase oscillator circuit 18 to provide power to the primary winding L5 of the leakage reactance. power transference transformer T2 alternatingly, and in opposite directions.

The counterphase oscillator circuit 18 has a first transistor Q1 and a second transistor Q2. The emitter 26 of the first transistor Q1 is coupled to the collector 27 of the second transistor Q2. A pair of direct current supply lines 28 and 29 are coupled, respectively, to the collector 30 of the first transistor Q1 and to the emitter 32 of the second transistor Q2. A pair of charging capacitors C5 and C6 are series connected across the direct current supply lines 28 and 29. Each of the capacitors C5 and C6 is coupled to least partially turn on a single one of the transistors at the beginning of each half cycle. That is, the capacitor C5 is used to partially turn on the transistor Q1 and the capacitor C6 partially turns on the transistor Q2. A lead 34 connects the emitter 26 of the first transistor Q1 and the collector 27 of the second transistor Q2 to the primary winding L5 of the leakage reactance power transference transformer T2. A lead 36 is connected from the other end of the primary winding L5 to a tap 42 between the charging capacitors C5 and C6.

The two series connected transistors Q1 and Q2 are driven in alternating sequence. The bases 44 and 46 of the transistors Q1 and Q2, respectively, are alternatively biased by oppositely wound secondary windings L1 and L2 respectively, of the pulse generator base driving transformer T1. The pulse generator base driving transformer T1 is interposed between the counterphase oscillator circuit 18 and the leakage reactance power transference transformer T2 to provide periodic or oscillating pulses to the primary winding L5 of the power transference transformer T2. The base driving transformer T1 has a primary winding L3 and two output secondary windings L1 and L2. The primary winding L3 is coupled in a loop to the feedback winding L4, which is an additional secondary winding of the power transference transformer T2. A capacitor C7 and a resistor R4 are coupled in parallel with each other and in series with the primary winding L3 and the feedback winding L4 to control the duration of pulses provided to the counterphase oscillator circuit 18 by the pulse generator base driving transformer T1.

In the embodiment depicted in FIG. 1, the base driving transformer T1 has dual secondary output windings L1 and L2, each respectively connected in circuit between the emitter and the base of the associated one of the transistors Q1 and Q2, as depicted. A diode D5, a capacitor C2 and a resistor R1 are connected in parallel to the base 44 of transistor Q1 and to one lead of the secondary winding L1 of the base driving transformer T1. Similarly, a diode D6, a capacitor C3 and a resistor R2 are connected in parallel to the base 46 of the transistor Q2 from one lead of the secondary winding L2 of the base driving transformer T1. The base driving transformer secondary winding L1 is coupled to the base 44 of the transistor Q1 while the base driving transformer secondary winding L2 is coupled to the base 46 of the transistor Q2.

A full wave rectifying bridge 12 employing diodes D1–D4 and a filtering capacitor C1, is coupled to 120 volt, 60 hertz alternating current supply lines 14 and 16.

A resistor R3 and a capacitor C4 are coupled in series across the direct current output terminals of the full wave rectifying bridge 12. The resistor R3 and the resistor R2 together form a voltage dividing circuit. A diac 49 serves as an active element of the oscillator starting circuit and is coupled to the junction between the resistor R3 and capacitor C4 and to the base 46 of the transistor Q2.

The starting circuit for the counterphase oscillator circuit 18 is formed of the resistor R3, the capacitor C4 and the diac 49 which is a bilateral triggering device. These circuit elements provide a stating pulse to the transistor Q2 which is initially turned "on" in saturation by current from the full wave rectifying circuit 12.

The rectifier 12, through resistor R3, charges the capacitor C4 positively at its junction 50 with resistor R3. When this positive charge reaches the voltage breakdown point of the bilateral triggering diac 49, a positive pulse is applied through the diac 49 to the base 46 of the transistor Q2. This starts the oscillation of the counterphase oscillator circuit 18.

The transistor Q2 is held "on" for the first half cycle of oscillation by the positive voltage induced in the secondary winding L2 of the base driving transformer T1. During the time that Q2 is turned on, the voltage impressed on the primary L5 of the power transference transformer T2 is almost half the power source voltage applied across the alternating current input lines 14 and 16. This voltage feeds power to the load, the neon lamp 1, through the secondary winding L6. Sufficient power is provided to the feedback winding L4 to supply energy through the base driving transformer T1 to keep the transistor Q2 on and in saturation at a current level equal to the secondary load lamp current reflected into the primary L5.

The transistor Q2 is initially supplied with current by the full wave rectifier 12 and capacitor filter C1. There is an electron flow from the collector 27 of transistor Q2 to the line 52 leading to the primary L5 of the power transference transformer T2. Electron flow is through the primary winding L5 from end 9 to end 10 and through line 36 to the tap 42 between capacitors C5 and C6. From there the electron flow is through the capacitor C6 to the line 54 and then to the emitter 32 of transistor Q2 through line 29. An electron flow also occurs from the emitter 32 of transistor Q2 through the resistor R2 and from the end 6 to the end 5 of secondary winding L2 of the pulse generator transformer T1. At the same time, there is an electron flow from line 34 and from the end 2 to the end 1 of the pulse generator base driving transformer T1 to provide a reverse bias to the transistor Q1.

The voltage at the collector 26 of the transistor Q2 is a square wave pulse. The current flowing from the collector 27 of transistor Q2 is 180 degrees out of phase with the collector voltage. The flow of current from the collector 27 of the transistor Q2 is held on for the balance of the first half cycle by the positive voltage induced in the secondary winding L2 of the pulse generator base driving transformer T1 by the saturation of transformer T1. An opposite polarity voltage is induced in the secondary winding L1 of the pulse generator base driving transformer T1 during the transistor Q2 "on" time. The voltage in the secondary winding L1 holds transistor Q1 off during the transistor Q2 "on" time.

The dot notation on the windings of the transformers T1 and T2 indicates a common polarity. That is, if in one winding the dotted end is at any time, for example, positive relative to the non-dotted end, the dotted ends of all of the other windings are simultaneously positive relative to their non-dotted ends. Conversely, when any one dotted end is negative relative to the non-dotted end of a winding, all of the other non-dotted ends of the other windings are simultaneously negative with respect to their own non-dotted ends.

If transistor Q2 is on, it is in saturation and the non-dotted end 6 of winding L2 is positive relative to the dotted end 5. By observing the dot convention of winding L2 it is apparent that the Q2 base end 6 is positive with respect to the end 5 feeding resister R2 and has the correct polarity to turn transistor Q2 "on". The value of resistor R2 is chosen small enough to saturate transistor Q2 at its maximum gain and maximum load current.

Observing the dot convention depicted in FIG. 1, it is apparent that the base ends 6 and 1 of secondary windings L2 and L1, respectively, of the pulse generator base driving transformer T1, are always of opposite polarity. Therefore, as long as transistor Q2 is driven on by the induced voltage from the primary L3 of pulse generator base driving transformer T1, transistor Q1 is held "off". The contrary is also true.

Transistor Q2 remains on as long as there is a voltage induced in winding L2 by coupling to the primary L3 of the pulse generator base driving transformer T1. This "on" time is fixed by transformer T1 and the feedback voltage from the winding L4 by the fundamental magnetic relationship:

$$V_{L3} = N_P A_C \, (dB/dT)$$

$V_{L3}$ is the instantaneous primary voltage of base driving transformer T1 in volts. $N_P$ is the number of primary turns of transformer T1. $A_C$ is the cross-sectional core area of transformer T1 in square centimeters. dB/dT is the instantaneous rate of change of magnetic flux density in gauss per second.

As long as transistor Q2 is in saturation, there is a constant voltage across the primary winding L3 of transformer T1 and the fundamental magnetic relationship dictates a constant dB/dT. With reference to FIG. 8, if the transformer core magnetic flux commences at point B, which is minus B max., on the hysteresis loop, it moves linearly up in flux density along the flux path through point C at a rate given by dB/dT. When it reaches point D at +B max. there can be no further dB/dT. Therefore, there can be no voltage across winding L3 and, as a result, no voltage across the secondary winding L2 of the transformer T1. This is simply another way of stating that at +B max. the slope of the hysteresis loop or core permeability, and hence, the transformer T1 primary impedance have fallen to zero. The voltage across the primary L3 of transformer T1 thus falls to zero and the collector 27 of transistor Q2 is forced up toward source power voltage. Since the voltage across the primary L3 collapses, so does the voltage across the secondary L2. Now, as the voltage across all collector and base windings collapses to zero, the current from winding L2 through resistor R2, which had been directed into the base 46 of transistor Q2, is partially diverted into transistor Q1, thereby turning transistor Q1 partially on. Current in transistor Q1, because of the direction of the secondary winding L1, represents negative coercive force. The core operating point of the transformer T1 moves on the hysteresis loop of FIG. 8, and as current tends to increase in the negative coercive force direction, the core is again in a region of high permeability, indicated at point F in FIG. 8. Voltage can then be sustained across the primary winding L1 of transformer T1 with end 4 thereof negative.

With a high impedance in the collector 30 of transistor Q1, the voltage potential in collector 30 starts to fall as current increases. Also, a voltage starts to appear across the primary L5 of the power transference transformer T2. As a result of the transformer action of pulse generator base driving transformer T1, a voltage also appears across secondary winding L1 as well. This provides additional drive to the base 44 of transistor Q1 beyond that from resistor R1. As a result, the collector 30 of transistor Q1 is driven negative even more rapidly. This process continues regeneratively until the collector 30 of transistor Q1 is in saturation. At this time, flux moves down along the path of the hysteresis loop in FIG. 8, through point G to point H. At −B max. the drive to the base of transistor Q1 collapses as the core of the transformer T1 saturates in the negative direction. The same flipover to partially turn transistor Q2 "on" occurs, followed by a full, regenerative turn-on which again saturates the transistor Q2. The core of transformer T1 again moves up the hysteresis loop path. This process continues with the transformer T1 moving cyclically over its entire hysteresis loop from −B max. to +B max. on one half cycle, then down from +B max. to −B max. on the next, as depicted in FIG. 8.

The circuit configuration of FIG. 1 has the advantage of reducing the applied voltage across the inverter transistors Q1 and Q2 from two times the power source voltage on the direct current output of the rectifier 12 to a value equal to the output voltage of the rectifier. This is a half bridge converter, which replaces two of the inverter transistors with the two capacitors C5 and C6 which are coupled across the output of the full wave rectifier 12 with the primary L5 of the leakage reactance power transference transformer T2 fed from the tap 42 between the capacitors C5 and C6. The use of the capacitors C5 and C6 in place of a pair inverters constitutes a more economical arrangement as compared to other electronic converters. The primary L5 of the power transference transformer T2 is fed effectively from capacitors C5 and C6 in parallel. When transistor Q1 is turned on, current flows through the primary L5 of transformer T2 into the junction of the capacitors C5 and C6 and replenishes the charge lost by both capacitors in the half cycle when transistor Q2 was on and drew current out of the junction of the capacitors C5 and C6.

Because the neon lamp 1 requires both a very high starting voltage and a high operating voltage, the ballast impedance required to stabilize the negative impedance of this type of lamp is achieved with a uniquely designed leakage reactance power transference transformer T2. The ballast impedance is incorporated in the design of the transformer T2 to deliberately introduce leakage reactance, as illustrated in FIG. 5. Such a transformer is known as a "stray-field" or "leakage reactance" transformer.

In a power transformer the voltage and current taken by a load connected to the secondary winding is transformed or reflected into corresponding volts and amperes which have to be supplied to the primary winding. This transfer of energy from one winding to another can simply be considered as taking place through the magnetic field which links the two windings. In a conventional power transformer, the mutual magnetic field which links both windings must be kept as high as possible so that a maximum energy is transferred. For this reason, a core is typically provided to increase and guide the magnetic flux, and the two windings are placed close together so that the same magnetic flux links both.

In the unique design of the power transference transformer T2 mutual magnetic flux linking the primary and secondary windings is deliberately reduced, and only a limited amount of energy is allowed to be transferred to the load (the neon lamp 1). In order to reduce the mutual flux and increase the leakage flux, the transformer T2 is provided with a core 58 having a plurality of limbs. That is the transformer 58 of FIG. 5 is constructed in a generally rectangular shape having linear limbs 59, 60, 61 and 62.

The core 58 is formed from two U-shaped sections 64, depicted in FIGS. 3 and 4. Each of the sections 64 has a back 65 and a pair of legs 66 upstanding therefrom. Each of the core sections 64 is of circular cross-section, as depicted in FIG. 4. It should be understood that the core cross-section can be a square, rectangular or any other shape. The feedback winding L4 is wound about the back 65 of one of the core sections 64, and the legs 66 of the two core sections 64 are inserted from opposite directions into the hollow interiors of the bobbins 68 and 70 of the primary and secondary windings L5 and L6, respectively, to complete the rectangular, multilimbed core 58. As illustrated in FIG. 5, the primary and secondary windings L5 and L6, respectively, are mounted on two separate and different limbs 61 and 59 of the core 58.

The field 72 of the leakage flux reactance which is created about the primary winding L5 exerts only a limited effect on the secondary winding L6. The internal magnetic lines of flux within the transformer core 58 are indicated at 74.

The secondary winding L6 has a high voltage, as is required by neon lamps. The voltage induced in the secondary winding L6 is from 500 volts up to 15,000 volts, depending upon the length of the neon lamp 1. In order to obtain this high voltage, a great many turns of wire are necessary to form the secondary L6. The large number of turns in the secondary L6 results in two problems. The high potential difference between layers of turns in the secondary L6 requires a very good insulation between layers to avoid dielectric breakdown. The interpositioning of such layers in the secondary of a conventional neon lamp transformer results in a transformer having an excessively large size. The other problem with the design of conventional neon lamp transformers resides in the effects of stray capacitance between the windings and layers of windings in the secondary. Such stray capacitance has an important effect on power loss.

Both of the foregoing problems have been overcome with the design of the leakage reactance power transference transformer T2 in the electronic transformer system 10 of FIG. 1. The construction of the secondary L6 of the transformer T2 is illustrated in FIG. 2. The secondary L6 includes a bobbin 70. The bobbin 70 is a molded non-conductive structure, preferably formed of a dielectric plastic. The bobbin 70 has a cylindrical inner sleeve 74 and annular end plates 76 and 78. The bobbin 70 also has annular partitions 80 spaced periodically and extending radially outwardly from the sleeve 74 between the end plates 76 and 78. The insulated wire is wound in loops on the bobbin 70 so that the secondary L6 is divided into annular sections which are longitudinally separated by the dielectric partitions 80, as illustrated in FIG. 2. In the embodiment depicted, the secondary L6 is divided into 8 longitudinally separated sections. This has the result of reducing the insulation requirement between layers of windings on the bobbin 70. In the power transferance transformer L6, the spatial separation between very large voltages is quite large compared to conventially wound transformers, because of the segmented secondary winding L6.

While transformer windings are generally considered merely as large inductances, they also contain capacitance distributed throughout the windings in different ways, depending upon the type of coils and the arrangement of the windings. At low operating frequencies, such as the 60 hertz frequency of public utility lines, the effect of the stray capacitance between turns and layers of individual coils is negligible. As a result, the windings act as simple, concentrated inductances giving uniformly distributed voltage. However, when the windings are subjected to a sudden impact of high voltage and high frequency, the effect of stray capacitance in determining the voltage distribution becomes quite important. These capacitances are relatively unimportant at low frequencies. However, at high frequencies the capacitances have very low impedances, or even become virtually short circuits when subjected to high frequency waves or to steep fronted pulses, as occurs with the square wave form of an electronic inverter. Moreover, at high frequencies conditions of resonance may be reached for various combinations of inductances and capacitances.

The effect of stray capacitances may be explained with greater clarity by first considering the effect of an alternating current voltage impressed upon an inductance and a capacitance in parallel. With a constant applied voltage the current taken by the capacitance is directly proportional to the frequency, while the current taken by the inductance is inversely proportional to the frequency. The particular frequency at which these two currents are equal is termed the resonant frequency for such a parallel combination. At the resonant frequency the currents are equal and opposite. The combination therefore draws no resultant current from an external circuit, no matter how high the voltage may be. Such a parallel combination, therefore, acts like an open circuit at the resonant frequency. As is well know, such a parallel combination of an inductance and a capacitance acts, with respect to an external circuit, like a capacitance at frequencies above the resonant frequency and like an inductance at frequencies below the resonant frequency.

It is also helpful to consider two separate parallel combinations of an inductance and a capacitance in which the individual combinations are connected in series with each other, where the two combinations have different resonant frequencies. The results at frequencies between the resonant frequencies, so far as the voltage across the individual combinations and the current in the external circuit are concerned, are the same as with a single inductance and a single capacitance in series. In the context of the present invention, the external circuit should be considered to be the inverter, because of the impedance reflected onto the primary L5 by the secondary L6 of the power transference transformer T2.

If an alternating current voltage is impressed across an inductance and a capacitance in series, the same current flows through both due to the series connection, but the voltages across the inductance and capacitance are in opposition to each other with the applied voltage being the resultant of these two individual voltages. With a constant value of current in the series circuit the voltage across the inductance is proportional to the frequency, while the voltage across the capacitance is inversely proportional to the frequency. The resonant frequency is the frequency at which these two voltages are equal.

Except for the effects of the losses in the series circuit, the voltage across the inductance and capacitance would be infinite, even though a finite voltage was applied across the combination. As a result, at resonant frequency the combination acts as a short circuit. At frequencies lower than resonance the voltage across the capacitance will be greater than that across the inductance. At frequencies higher than resonance the voltage across the inductance will be greater than that across the capacitance. The combination will therefore act like a capacitance at frequencies below resonant frequency and like an inductance at frequencies above resonant frequency.

The effects of a sudden application of voltage to typical combinations of inductances and capacitances should now be considered. In the simple case of a pure capacitance only, the current at the first instant is limited only by the characteristics of the inverter circuit. Due to the inductance of this circuit, the current cannot instantly build up in it. Therefore, the voltage across the capacitance will be zero at the first instant. As the capacitor is charged the voltage will build up to the rate of value of the capacitor and the current will cease to flow. During the first instant, therefore, the capacitor acts as a short circuit, but changes to act like an open circuit once it is fully charged. The response of a pure inductance to a sudden application of voltage is the reverse of that exhibited by a capacitor.

With an inductance and capacitance connected in parallel, the combination acts as a short circuit at the first instant of impact of the exciting electric wave due to the presence of the capacitor. Finally, it also acts as a short circuit due to the presence of the inductor.

With an inductance and capacitance in series, the combination acts wholly as an open circuit at the first instant because current cannot flow continuously through the inductor. The combination also acts wholly as an open circuit once the capacitor fully charges because current cannot flow continuously through the capacitor. At the first instant the total voltage is applied across the inductor, while finally the total voltage acts entirely across the capacitor. During the interval between the first instant and the final condition a voltage oscillation occurs with a maximum voltage across the inductance equal to the applied voltage, and a maximum voltage across the capacitance equal to twice the applied voltage.

In a conventional neon lamp transformer capacitance and inductance are distributed as shown in FIGS. **6*a* and 6*b*. The capacitances 82 between portions of the same winding 84 act in parallel with the inductances of the same portions. There are, therefore, as illustrated in FIG. 6*b*, various parallel combinations of inductances 86 and capacitances 87** in series with various other similar combinations. This provides the opportunities for resonance and excessive internal voltages at various points inside the windings. These resonances and excessive internal voltages occur internally at different frequencies.

A consideration of the foregoing explanations shows that it is possible to obtain high transient voltages between turns as a result of the impact voltage due principally to the front edge of the square wave form in an inverter. This can result in serious trouble and failures in a conventional neon lamp transformer system due to the severity of the dielectric stresses on the insulation between turns. These dielectric stresses are determined by the frequency and steepness of the front edge of the wave form, the amplitude of the wave, and the ratios between various capacitances of the windings.

The situation is especially serious at resonant conditions. Moreover, the possibility of obtaining resonant conditions with a square wave is quite probable due to the high harmonic components of this type of wave form. With the sectionalized winding of a multiple section bobbin, as shown in FIG. 2, the diagram of the stray capacitance takes the form of FIGS. *7a* and *7b*, rather than that of FIGS. *6a* and *6b*. As is well known, the resonant frequency is inversely proportional to the square root of the capacitance. Where the capacitance is smaller, the frequency of the resonant conditions is higher. As a consequence, the resonant conditions will be present at higher harmonics where amplitudes are greatly reduced.

Another disadvantage of high stray capacitances is that the inverter sees a reflected capacitance as a load. As is known, this is the worst condition for an inverter. A capacitive load changes the current wave form through the primary of the power transference transformer, but the voltage wave form remains uneffected. The voltage wave form remains a square wave, but current spikes appear in the primary each time the transistors of the inverter are switched to begin to conduct. When an inverter transistor begins to conduct, it supplies power to reverse charge the capacitance through a very low impedence. With the voltage constant, the current rises to high levels until the capacitance, as it charges, begins to represent a rising impedance in the load. Until the capacitance charge rises there is very little impedance to slow the on-rush of current to the transistor, other than the slight resistance in the transformer wire and the saturation resistance of the transistor. This situation is repeated each half cycle as the wave form changes it polarity. Because the current level rises to a high value as each transistor begins to conduct, the $I^2R$ losses in the inverter rise, and the efficiency decreases.

The eventual result of such current spikes on the operation of the inverter transistors may well be the desctruction of the transistors. The high peak currents cause the transistor switches to run out of driving power, and to pull out of saturation into a condition of high dissipation, which can cause them to burn out. The energy loss per cycle in the form of heat in each transistor is $\frac{1}{2} C_S(E_o)^2$. $C_S$ is the stray capacitance and $E_o$ is the output voltage of the secondary of the transformer T2. It can be seen, therefore, that it is very important to reduce the stray capacitance of the power transference transformer.

The Federal Communication Commission (FCC) requires that in electronic devices conducted emissions on the alternating current lines between 10 kilohertz and 30 megahertz must be at a very low level to avoid interference on radios and communication equipment. Due to the considerable harmonic components in electronic inverters, it is often necessary to provide low pass filters in order to meet the FCC requirements. In the embodiment of FIG. 1 a pair of inductors L7 and L8 are wound in bifilary fashion on a common core, indicated at 88. The inductors L7 and L8 are wound in bifilary fashion, as indicated by the dot notation, to avoid core saturation. The inductor L7 is positioned in the alternating current line 14 while the inductor L8 is positioned in the alternating current line 16. The input current on the alternating current lines 14 and 16 flows through these two inductors L7 and L8 to feed the counterphase oscillator circuit 18. The input current is sufficient to saturate the core 88 which would normally cause the inductances to disappear. The current in the bifilar windings or inductances L7 and L8 flows in opposite directions to generate two magnetic fields. Both magnetic fields have the same magnitude, but are in opposite directions, thus cancelling each other out. This avoids saturation of the core 88.

As is well known, the impedance of an inductance is directly proportional to the frequency. The inductance impedance is given by the formula $X_L=2\pi fL$, where $X_L$ is impedance of the inductance, f is the frequency, and L is the value of the inductor. With the arrangement of inductors L7 and L8, there is a very high impedance in the return to the alternating current line to frequencies in the range between 10 kilohertz and 30 megahertz. Harmonic components of the 60 hertz input frequency in this range are therefore very strongly attenuated.

A pair of capacitors C8 and C9 are coupled across the alternating current lines 14 and 16 with a coupling to ground indicated at 90 between the capacitors C8 and C9. The function of the capacitors C8 and C9 is to eliminate almost completely any harmonic interference in the range between 10 kilohertz and 30 megahertz.

The impedance of a capacitance is inversely proportional to the frequency as is shown by the formula $X_C=1/2\pi fC$, where $X_C$ is the capacitive impedance, f is the frequency, and C is the value of the capacitance. With the interposition of the capacitors C8 and C9 between the alternating current input lines 14 and 16 are ground, the attenuated harmonic components reaching the ends of the inductors L5 and L6 going toward the alternating current supply find a low impedance pass through the capacitors C8 and C9. Because the junction of these two capacitors is grounded, the harmonic components are shunted to ground and therefore almost completely eliminated.

The varactor V in FIG. 1 is a surge protector that is included to protect the circuit against transients on the alternating current lines 14 and 16. The transformer system 10 is also protected by a fuse 92 in the hot alternating current line 16.

The embodiment of FIG. 1 illustrates an embodiment of an electronic transformer system according to the invention operated in the most usual manner. That is, the system is operated from commercially available alternating current power provided by public utilities. Commercial alternating current is provided to the full wave rectifier 12 which is coupled across the pair of alternating current lines 14 and 16. The rectifier 12 is coupled to supply power to the counterphase oscillator circuit 18. It should be recognized, however, that the invention also finds utility where the direct current source is a battery, such as a conventional 12-volt motor vehicle battery. The embodiment of FIG. 9 illustrates an electronic transformer system 10' which is designed to be powered by a 12-volt motor vehicle battery. The positive terminal 94 is connected to the positive post of the motor vehicle battery and the negative terminal 96 is connected to the negative terminals of the motor vehicle battery. It is possible for the counterphase oscillator circuit 18', in the embodiment of FIG. 9, to employ a push-pull electronic inverter configuration because the low voltage of the battery permits use of cheap transistors Q1' and Q2' without reducing the emitter/collector voltage. The basic principles of operation of the electronic transformer system 10' of the embodiment of FIG. 9 are the same as described in conjunction with the transformer system of FIG. 1. Circuit elements in FIG. 1 which find corresponding structure in the embodiment of FIG. 9 are indicated by a primed notation in FIG. 9.

In the embodiment of FIG. 9 the secondary winding L6 of the power transference transformer T2' is the same as that depicted in FIG. 2 for the same reasons hereinbefore explained. A diode D8 is coupled in line 36' to ensure proper polarity of current flow in line 36'. The line 36' is connected to the center of the primary L5', rather than to one end of that primary, since the transistors Q1' and Q2' are coupled together in push-pull fashion, rather than in series as are the inverter transistors in FIG. 1. The opposite ends of the transformer primary L5' are respectively coupled to the emitters of transistors Q1' and Q2'.

A biasing resistor R9 is coupled between the base and collector of transistor Q1 , and another diode D9 is connected in series with the resistor R1' to ensure proper bias and polarity of the base of the transistor Q1'.

The foregoing descriptions of the preferred embodiments of the invention are presented in sufficient detail as will enable one skilled in the art to make and use electronic transformer systems according to the invention without undue experimentation. However, it is not intended to restrict or limit the invention to those details inasmuch as other elements may be substituted and improvements or modifications may be made to the embodiments depicted and described. Also such improvements, modifications and variations are contemplated within the scope of the invention and become readily apparent in view of the present specification. Accordingly, the invention should not be construed as limited to the specific embodiments depicted and described herein, but rather should be broadly construed within the full spirit and scope of the claims appended hereto.

We claim:

1. An electronic transformer system for illuminating lamps comprising:

a full wave rectifying means for receiving alternating current power as an input and for providing direct current power as an output, a counterphase oscillator means coupled to said full wave rectifying means, a leakage reactance power transference transformer having a core with a plurality of limbs, a primary winding on one of said limbs and coupled to said counterphase oscillator means, a plurality of dielectric partitions disposed on another of said limbs different from the limb upon which said primary winding is wound, and a secondary winding on said limb with said dielectric partitions wound to have a plurality of sections separated by said dielectric partitions and coupled to lamp terminals, and a feedback winding, and a pulse generator base driving transformer means having a primary winding coupled in series to said feedback winding of said leakage reactance power transference transformer and having secondary winding means for cyclically driving said counterphase oscillator means to provide power to said leakage reactance power transference transformer primary winding alternatingly in opposite directions.

2. An electronic transformer system according to claim 1 in which a bobbin is provided upon which said dielectric partitions are defined, and said secondary of said leakage reactance transformer is wound on said bobbin.

3. An electronic transformer system for illuminating lamps comprising:

a source of direct electrical current, a leakage reactance power transference transformer having a core with a plurality of limbs, a primary winding disposed about one of said limbs, a feedback winding, a secondary winding disposed about another of said core limbs and connected to lamp terminals and dielectric partitions separating said secondary winding into a plurality of sections, and a pulse generator base driving transformer means having primary winding coupled in series to said feedback winding of said power transference transformer and a secondary winding, counterphase oscillator means coupled in circuit and cyclically driven by said base driving transformer secondary winding and coupled to said direct current power source and to said power transference transformer primary winding to cyclically drive current through said power transference transformer primary winding sequentially in opposite directions.

4. An electronic transformer system according to claim 3 in which said source of direct electrical current is full wave rectifying means coupled across a pair of alternating current lines and the output of said full wave rectifying means is coupled to supply power to said counterphase oscillator means through a voltage dividing means.

5. An electronic transformer system according to claim 4 in which said counterphase oscillator means is comprised of two series connected transistors the bases of which are alternatively biased by associated, oppositely wound sections of said secondary winding of said pulse generator base driving transformer means.

6. An electronic transformer according to claim 4 further comprising a radio frequency filter in said pair of alternating current lines to filter harmonic emissions between about 10 kilohertz and about 30 megahertz.

7. An electronic transformer according to claim 6 in which said radio frequency filter is comprised of a pair of inductors, one in each alternating current line, wound in bifilary fashion on a common core, and a pair of capacitors coupled across said alternating current lines with a coupling to ground between said capacitors.

8. An electronic transformer system according to claim 4 further comprising a pair of capacitors coupled across the output of said full wave rectifying means and the primary of said leakage reactance power transference transformer former is fed from a tap between said capacitors.

9. An electronic transformer system according to claim 3 in which said dialectric partitions are defined on a bobbin and said secondary winding of said power transference transformer is wound on said bobbin.

10. In an electronic transformer system for providing power to lamps, the improvement comprising:

a leakage reactance transformer having a core with a plurality of limbs, a primary wound on one of said limbs, a bobbin disposed on another of said core limbs and defining a plurality of dialectric separaters, a secondary connected to terminals for said lamps and wound on said bobbin in a plurality of sections separated by said dialectric separaters, a feedback winding, a counterphase oscillator means coupled to provide power to said leakage reactance transformer primary, and comprised of an electronic inverter powered from a direct current source, and a pulse generator transformer having a primary coupled in series to said feedback winding of said leakage reactance transformer and having a secondary for providing electronic signals in alternating directions of current flow to drive said electronic inverter in counterphase oscillation.

* * * * *